US007178878B2

(12) United States Patent
Rompel

(10) Patent No.: US 7,178,878 B2
(45) Date of Patent: Feb. 20, 2007

(54) CHISEL

(75) Inventor: Markus Rompel, Brandon, FL (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/178,792

(22) Filed: Jul. 11, 2005

(65) Prior Publication Data

US 2006/0022511 A1 Feb. 2, 2006

(30) Foreign Application Priority Data

Jul. 13, 2004 (EP) ..... 04254159

(51) Int. Cl.
*B25D 17/02* (2006.01)
*B28D 1/26* (2006.01)

(52) U.S. Cl. ..... 299/100; 30/167.2

(58) Field of Classification Search ..... 299/100, 299/69, 38.1; 30/167, 167.2
See application file for complete search history.

(56) References Cited

U.S. PATENT DOCUMENTS

| | | | | | |
|---|---|---|---|---|---|
| 327,312 | A | * | 4/1885 | Reinhard | 30/167.2 |
| 964,393 | A | | 7/1910 | Clark | |
| 1,276,458 | A | | 8/1918 | Wagner | |
| 1,280,786 | A | | 10/1918 | McConnell | |
| 1,313,597 | A | * | 8/1919 | Hunter | 173/31 |
| 1,350,241 | A | | 8/1920 | Routh | |
| 1,359,015 | A | | 11/1920 | Argento | |
| 1,404,650 | A | | 1/1922 | Richard | |
| 1,511,880 | A | * | 10/1924 | Gest | 414/687 |
| 1,598,458 | A | | 8/1926 | Sullivan | |
| 1,719,449 | A | | 7/1929 | Rauko | |
| 1,730,822 | A | * | 10/1929 | Marston | 173/31 |
| 1,781,863 | A | | 11/1930 | Shoemaker | |
| 2,203,158 | A | | 6/1940 | Klein | |
| 2,392,495 | A | | 1/1946 | Nameth | |
| 2,490,565 | A | | 12/1949 | Williams | |
| 2,505,860 | A | | 5/1950 | Jockisch | |
| 2,621,405 | A | | 12/1952 | Facciuto | |
| 2,634,775 | A | | 4/1953 | Unsinger | |
| 2,693,028 | A | | 11/1954 | Stoddard | |
| 2,960,767 | A | | 11/1960 | VonHoff, Jr. et al. | |
| 3,097,429 | A | | 7/1963 | Frye et al. | |
| 3,191,909 | A | | 6/1965 | Reischl | |

(Continued)

FOREIGN PATENT DOCUMENTS

| | | |
|---|---|---|
| DE | 885 375 | 8/1953 |

(Continued)

*Primary Examiner*—John Kreck
(74) *Attorney, Agent, or Firm*—Harness, Dickey & Pierce, P.L.C.

(57) ABSTRACT

A channel chisel for forming a channel in a work piece, the channel chisel comprising a shaft having a longitudinal axis, a tip at one end of the shaft, wherein the tip has a cutting edge for cutting a work piece and a flute for removal of debris cut from a work piece, and at least one support member protruding from a side of the channel chisel, characterised in that the support member is adapted to abut and slide along a base of a channel to support the channel chisel in use, wherein support provided by the support member permits the channel chisel to pivot about the support member to change the angle at which the cutting edge cuts a work piece.

10 Claims, 1 Drawing Sheet

U.S. PATENT DOCUMENTS

| | | | | |
|---|---|---|---|---|
| 3,577,638 | A | | 5/1971 | Chandler |
| 3,673,686 | A | | 7/1972 | Benedict, Jr. |
| D331,866 | S | * | 12/1992 | Edy et al. ..... D8/47 |
| 5,409,300 | A | * | 4/1995 | Bourgoin ..... 299/69 |
| 6,901,621 | B2 | * | 6/2005 | Bruneau ..... 7/166 |

FOREIGN PATENT DOCUMENTS

| | | | | |
|---|---|---|---|---|
| DE | 1 000 986 | | | 1/1957 |
| DE | 84 38 186.8 | | | 4/1985 |
| EP | 0519493 | A1 | * | 12/1992 |
| GB | 2255521 | A | * | 11/1992 |
| WO | WO 92/02345 | | | 2/1992 |

* cited by examiner

CHISEL

BACKGROUND OF THE INVENTION

The present invention relates to chisels, and relates particularly, but not exclusively, to chisels for cutting a channel.

Often there is a need to form a channel in a work piece into which cables or pipes can be laid. The usual work piece is a concrete or similar hard ceramic surface. The ideal choice of tool is a chisel specifically shaped to cut such a channel, hereinafter referred to as a "channel chisel". In use the channel chisel can be connected to a reciprocating hammer apparatus like, for example, a portable power tool called a hammer, which repeatedly hits the channel chisel to transmit impact forces to it.

EP0519493 discloses a channel chisel comprising a shaft for insertion into the hammer and a tip that is inclined in relation to the axis of the shaft. The tip is U-shaped in cross-section and includes a flute to facilitate the removal of debris cut from the channel. A wing is formed on each side of the shaft. The wings are folded midway along their length so that a portion of each wing is inclined in relation to the longitudinal axis of the shaft. This enables that part of the wings to be supported on the upper surface of the work piece to fix the angle of the channel chisel in relation to the work piece and the depth at which the tip cuts into the work piece.

The channel chisel of EP0519493 suffers from the drawback that while the channel chisel is reciprocated up and down by the hammering forces of a hammer apparatus, the wings formed on either side of the shaft must repeatedly impact the upper surfaces of the work piece in which the channel is formed. This results in damage to the upper surface of the work piece at the edges of the channel. In order to minimise the damage caused, the wings have generally flat lower surfaces to reduce the pressure applied to the work piece by the impact forces. However, if the user wishes to increase the depth of the channel cut, the channel chisel must be tilted forward so that the front ends of the wings, instead of the flat lower surfaces, are supported by the upper surfaces of the work piece. This reduces the surface area of the wings contacting the work piece which results in an increase in the pressure applied at the points of contact and the consequential damage caused to the work piece. The user has no option but to tilt the channel chisel forward to increase the depth of channel cut as the wings are rigidly fixed to the channel chisel and their orientation cannot be altered.

Preferred embodiments of the present invention seek to overcome the above disadvantages of the prior art.

SUMMARY OF THE INVENTION

According to the present invention, there is provided a channel chisel for forming a channel in a work piece, the channel chisel comprising a shaft having a longitudinal axis, a tip at one end of the shaft, wherein the tip has a cutting edge for cutting a work piece and a flute for removal of debris cut from a work piece, and at least one support member protruding from a side of the channel chisel, characterised in that the support member is adapted to abut and slide along a base of a channel to support the channel chisel in use, wherein support provided by the support member permits the channel chisel to pivot about the support member to change the angle at which the cutting edge cuts a work piece.

A channel chisel having at least one support member protruding from a side of the channel chisel that is adapted to abut and slide along a base of a channel to support the channel chisel has the advantage that there is no contact between the channel chisel and the upper surfaces of the work piece being cut and so there will be no damage caused to the edges of the channel. When the support member abuts the base of the channel the channel chisel can also be tilted forward, or backward, about the support member to change the angle at which the cutting edge cuts the work piece. This enables the user to increase, or decrease, the depth of channel cut in the work piece. Whilst the depth of cut can be altered, the contact between the support member and the base of the channel is substantially unchanged. A support member protruding from the underside of the channel chisel also provides the advantage of a greater range of cutting depths, as there is no part of the channel chisel in contact with the upper surface of the channel to limit the depth to which the channel chisel can cut into the work piece.

The support member may be integrally formed with the channel chisel. This streamlines the manufacturing process of the channel chisel.

Alternatively, the support member can be made separately from, but permanently fixed to, the channel chisel by welding. This allows intricate shapes of support member to be made that may not be possible, or economical, if formed integrally with the channel chisel. For example, a support member with a roller, or bearing, adapted to reduce friction between the channel chisel and the base of the channel is a possible variant.

Another alternative is to detachably fix the support member to the channel chisel with a fastening means, like, for example, a screw or a dowel. This allows a support member adapted for cutting channels of a certain range of depths to be exchanged for another support member adapted for cutting a different range of depths. If the support member is fastened to the channel chisel then preferably there is an interlocking fit between channel chisel and support member, in addition to the fastening means, that prevents sheer or tension forces from acting upon the fastening means that could result in its failure and inadvertent removal of the support member.

The tip may be substantially U-shaped in cross-section in a plane transverse to the longitudinal axis. This cross-sectional shape is ideal for efficient debris removal from the tip. Preferably, the support member is located below the trough of the U-shaped tip.

The support member may have a rounded surface for abutment with the base of the channel. This allows the channel chisel to be tilted smoothly backward and forward. Preferably, the support member has a rounded hump shape in longitudinal cross-section. This shape gives a good range of tilt angles for the channel chisel.

Preferably, the channel chisel has a shank at the other end of the shaft, wherein the shank is adapted to be received in a reciprocating hammer apparatus.

A preferred embodiment of the invention will now be described, by way of example only, with reference the following drawings, in which:

DETAILED DESCRIPTION OF THE PREFERRED EMBODIMENTS

Figure 1:
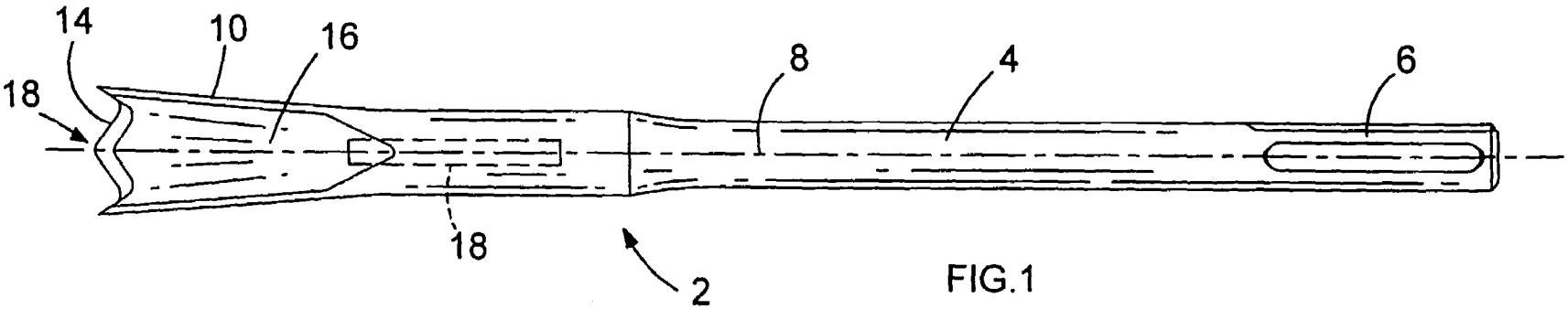
FIG. 1 is a plan view of a channel chisel embodying the present invention.
Figure 2:
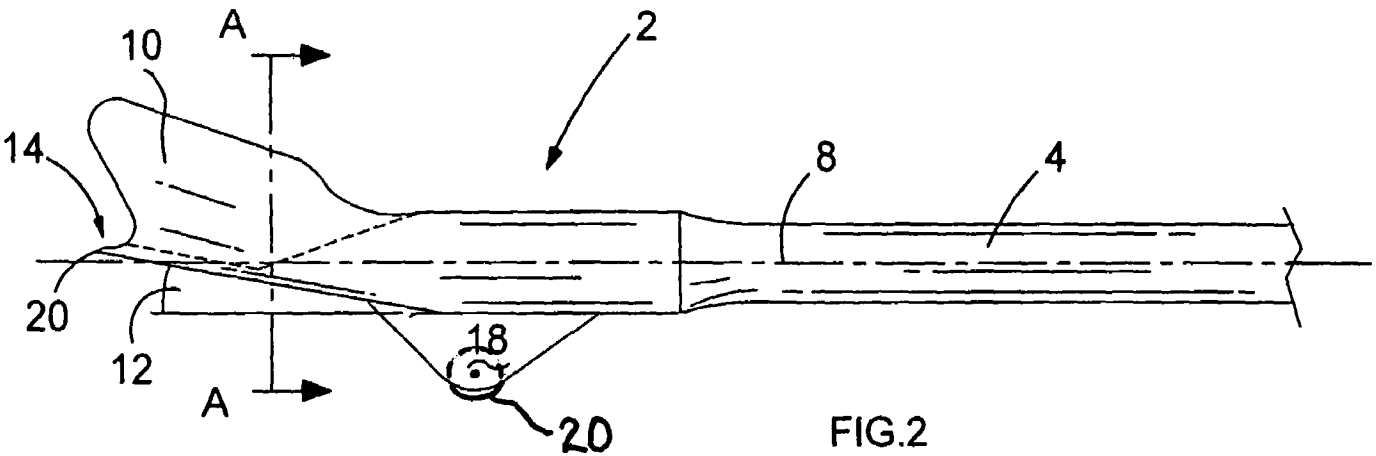
FIG. 2 is a side elevation view of the channel chisel of FIG. 1.
Figure 3:
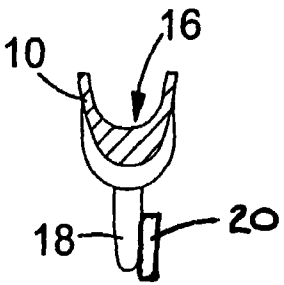
FIG. 3 is a cross sectional view of the channel chisel along line A—A of FIG. 2.

A channel chisel 2 comprises an elongate shaft 4 with a shank 6 at one end for connection to the output of a hammer apparatus (not shown). The shaft 4 and the shank 6 have a longitudinal axis 8. A tip 10 is formed at the other end of the shaft 4. The tip 10 is slightly inclined by an acute angle 12 in relation to the longitudinal axis 8. The tip has a cutting edge 14. As is shown FIG. 3, the tip 10 is U-shaped in cross-section to form a flute 16 within the confines of the tip 10. The flute 16 is for transporting debris cut from a work piece rearward from the cutting edge 14. A support member 18 protrudes radially outward from the underside of the trough of the U-shaped tip 10. The support member 18 may include a roller or bearing 20 adapted to reduce friction between the channel chisel 10 and the base of the channel.

To cut a channel in the surface of concrete, or the like, first the shank 6 is connected to the output of a hammer apparatus (not shown). Next, the user of the hammer apparatus places the tip 10 against the surface to be chiselled while holding the hammer apparatus in a generally vertical orientation. The operator then starts the hammer action of the hammer apparatus, which causes the cutting edge 14 of the channel chisel 2 to penetrate the surface. With the channel chisel 2 in a substantially vertical orientation, the channel chisel cuts into the concrete until it reaches an appropriate depth. The operator then tilts the hammer apparatus backward so that the channel chisel begins to move forward through the concrete being cut. This continues until the support member 18 rests on the base of the channel, so that the lowest extreme 20 of the cutting edge 14 and the bottom of the support member 18 lie in a generally horizontal plane containing the base of the channel.

In this orientation, forward movement of the channel chisel 2 through the surface of the concrete cuts a channel of constant depth. No part of the channel chisel 2 contacts the upper surfaces of the concrete and, as a result, there is no damage to the edges of the channel being cut. Also, the user is free to tilt the channel chisel backward or forward to alter the depth of the channel cut.

It will be appreciated by persons skilled in the art that the above embodiment has been described by way of example only, and that various alterations and modifications are possible without departure from the scope of the invention as defined by the appended claims.

The invention claimed is:

1. A channel chisel for forming a channel in a work piece, the channel chisel comprising:

a shaft having a longitudinal axis;

a tip at one end of the shaft, wherein the tip has a cutting edge for cutting a work piece and a flute defining a trough in said tip for removal of debris cut from a work piece through said trough of said tip; and at least one support member protruding from a side of the channel chisel below said trough, characterised in that the support member is adapted to abut and slide along a base of a channel to support the channel chisel in use, wherein support provided by the support member permits the channel chisel to pivot about the support member to change the angle at which the cutting edge cuts a work piece.

2. A channel chisel as claimed in claim 1, wherein the support member is integrally formed with the channel chisel.

3. A channel chisel as claimed in claim 1, wherein the support member is formed separately from and is permanently fixed to the channel chisel.

4. A channel chisel as claimed in claim 1, wherein the support member is formed separately from and is detachably fixed to the channel chisel.

5. A channel chisel as claimed in claim 1, wherein the support member has a roller, or a bearing, adapted to reduce friction between the channel chisel and a base of a channel in a work piece.

6. A channel chisel as claimed in claim 1, wherein the tip has a substantially U-shaped cross-section in a plane transverse to the longitudinal axis.

7. A channel chisel as claimed in claim 6, wherein the support member is located below the trough of the U-shaped tip.

8. A channel chisel as claimed in claim 1, wherein the support member has a rounded surface for abutment with the base of the channel.

9. A channel chisel as claimed in claim 1, wherein the support member has a rounded hump shape in longitudinal cross-section.

10. A channel chisel as claimed in claim 1, wherein the channel chisel has a shank at the other end of the shaft, wherein the shank is adapted to be received in a reciprocating hammer apparatus.

* * * * *